United States Patent [19]

Reese

[11] 4,211,435

[45] Jul. 8, 1980

[54] COMBINATION CONTAINER AND CONTROL FORM FOR SHIPPING, IDENTIFYING AND REORDERING MERCHANDISE

[76] Inventor: Jonathan Reese, Hallandale, Fla.

[21] Appl. No.: 690,077

[22] Filed: May 26, 1976

Related U.S. Application Data

[63] Continuation of Ser. No. 348,066, Apr. 5, 1973, abandoned, which is a continuation-in-part of Ser. No. 207,249, Dec. 13, 1971, abandoned.

[51] Int. Cl.[2] ..... B41L 1/26

[52] U.S. Cl. ..... 282/25

[58] Field of Search ..... 282/22 R, 23 R, 25, 282/11.5 R, 11.5 A; 283/6 B; 229/69, 70, 72

[56] References Cited

U.S. PATENT DOCUMENTS

| | | | |
|---|---|---|---|
| 1,177,886 | 4/1916 | Newcomb | 229/70 X |
| 1,319,525 | 10/1919 | Gilbertson | 229/70 |
| 2,302,992 | 11/1942 | Gardner | 282/25 X |
| 2,558,813 | 7/1951 | Brechner | 282/25 |
| 2,954,154 | 9/1960 | Mooney | 229/70 |
| 3,428,237 | 2/1969 | Dowen | 229/69 |
| 3,489,433 | 1/1970 | Lanigan et al. | 282/23 R X |
| 3,658,239 | 4/1972 | Foutz | 229/72 X |

FOREIGN PATENT DOCUMENTS

| | | | |
|---|---|---|---|
| 687354 | 2/1953 | United Kingdom | 282/22 R |

*Primary Examiner*—Stephen C. Pellegrino

*Attorney, Agent, or Firm*—Robert E. Burns; Emmanuel J. Lobato; Bruce L. Adams

[57] ABSTRACT

An assembly for shipping, stocking and reordering merchandise comprises a container for receiving the merchandise, a label identifying the merchandise in the container, the customer to whom the merchandise is to be shipped and an order number, and a detachable reorder form which identifies the customer and the merchandise and provides a blank for filling in the quantity of merchandise to be reordered. Thus the same merchandise can be reordered from the supplier merely by detaching the reorder form, filling in the desired quantity and returning the reorder form to the supplier. Preferably the assembly further includes one or more detachable identification labels suitable for attachment to individual pieces of merchandise. By way of example the assembly comprises a three-ply continuous manifold divided by spaced transverse tear lines into a succession of rectangular units each having a sealable envelope for shipping merchandise, a pocket for a card controlling the filling of an order for the merchandise, a plurality of severable labels for attachment to individual articles of merchandise by the customer, and duplicate stubs for reordering the merchandise. The labels bear identification of the merchandise and the reorder stubs and the face of the envelope bear identification of the merchandise and of the customer and an order number.

16 Claims, 7 Drawing Figures

COMBINATION CONTAINER AND CONTROL FORM FOR SHIPPING, IDENTIFYING AND REORDERING MERCHANDISE

This application is a continuation of application Ser. No. 348,066, filed Apr. 5, 1973 which is a continuation-in-part of application Ser. No. 207,249, filed Dec. 13, 1971, both now abandoned.

The present invention relates to a combination container and control form for shipping, stocking and reordering merchandise. Although not limited to its field of application, the combined shipping container and control form in accordance with the invention is particularly useful in shipping goods from a supplier to a retailer or wholesaler, or in supplying parts or components to a manufacturer.

Heretofore, when a customer has desired to reorder merchandise from a supplier he has generally used his own order form. In making out the order it has been necessary for him to fill in the name and address of the supplier and an identification of the desired goods as well as the quantity of goods desired. Not only does this require an appreciable amount of paper work but affords the possibility of error, for example in the identification of the goods being reordered.

It is an object of the present invention to provide a combined shipping container and control form that facilitates the shipping, identification, inventorying and reordering of the merchandise and thereby reduces the labor and hence the cost involved in these operations. It not only makes possible important economies to the supplier or wholesaler in the processing and shipping of orders and reorders of merchandise, but also promotes good customer relations by assisting the customer in keeping an inventory of the merchandise and in reordering the merchandise when his supply needs to be replenished. Moreover, the form in accordance with the present invention preferably provides one or more detachable tags or labels which are suitable for attachment to individual pieces of the merchandise.

While the combined shipping container and control form in accordance with the present invention is useful in many different fields for many different kinds of merchandise, it is herein described by way of example for use in merchandising and shipping small articles such as jewelry, watches and watch parts, and electronic components from a supplier or wholesaler to retailers or to a manufacturer using component parts.

When used for shipping small articles, the combination containers and control forms in accordance with the present invention are conveniently made in the form of a continuous manifold suitable for processing by high speed computer controlled equipment, thereby making possible important economies in the processing of the customer's orders. Such equipment may include a high speed printer for printing on the container or attached label an identification of the merchandise in the container, the customer to whom merchandise is to be shipped and an order number. Moreover, at the same time the printer prints on a reorder form the identity of the customer and the merchandise while leaving a blank to be filled in as to the quantity of merchandise to be reordered. Hence when he wishes to reorder the merchandise, the customer need only fill in the quantity and return the reorder form to the supplier. This not only reduces the labor and hence the cost involved in the transaction, but also reduces the possibility of error.

The nature and advantages of the invention will be more fully understood from the following description of a preferred embodiment of the invention shown by way of example in the accompanying drawings in which.

Figure 1:
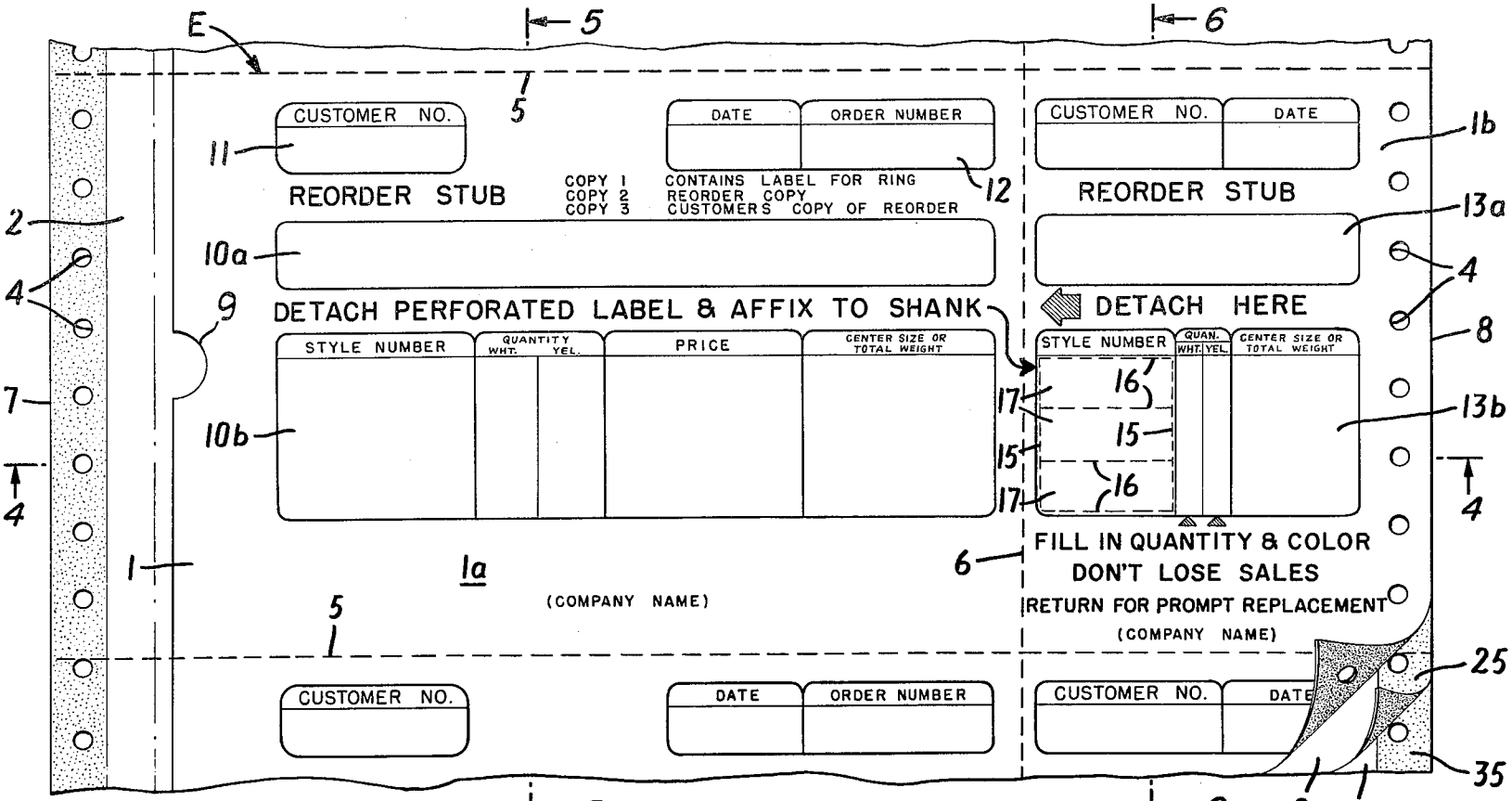
FIG. 1 is a front view of a representative portion of a three-ply manifold in accordance with the present invention suitable for merchandising jewelry, for example, rings.

The manifold shown by way of example in the drawings comprises three superposed plies each formed of a continuous band or strip of paper or other strong, flexible, cheap material. Adjacent each of the side edges of the manifold there is provided a row of spaced holes 4 for feeding the manifold through a printer or other processing equipment. The manifold is continuous but is provied with longitudinally spaced, transversely extending tear lines 5, herein referred to as a line of perforations, along which the manifold is readily parted to provide a succession of like units. Moreover the manifold is provided with a longitudinally extending tear line 6 which is spaced farther from the left-hand edge 7 as seen in FIG. 1, than from the right-hand side edge 8 so as to divide each of the units into a larger rectangular portion and a smaller rectangular portion. The cuts or perforations of the tear lines 5 and 6 extend through all three plies of the manifold so that all of the plies can be parted simultaneously along the tear lines.

The larger left-hand portion **1*a* of the front ply 1 of the manifold to the left of the tear line 6 forms the front of an envelope E which is adapted to receive the merchandise to be shipped. The left-hand edge 7*a* of the front ply 1 is spaced inwardly from the side edge 7 of the manifold and is provided with an arcuate cut-out 9 at the center of each of the units. The front ply of the envelope is provided with a description 10*a* of the merchandise and with further identification 10*b* of the merchandise, for example, by style, number, quantity, price and size. The front of the envelope is further provided with an identification 11 of the customer, for example, a customer number, and with an order number 12**. Other information may be provided on the front of the envelope E such as the date, the name of the supplier, and instructions for using reorder stubs and labels as described below.

The smaller portion **1*b* of the front ply 1 at the right-hand side of the tear line 6 as seen in FIG. 1 likewise bears a description 13*a* of the merchandise and further identification 13*b* showing, for example, the style number, quantity and size of the rings or other merchandise to be shipped in the envelope E. Other information such as the order number, date, company name and instructions may also be provided on the portion 1*b*. The portion 1*b* is further provided with spaced longitudinally extending tear lines 15 and spaced transversely extending tear lines 16 defining a plurality of tags or labels 17 which are separable from the rest of the portion 1*b* and from each other along the tear lines. The tear lines 15 and 16 are formed by perforations through the first ply only of the manifold. Each of the tags or labels 17 carries suitable identification of merchandise to be received in the envelope, for example, a style number. The rear faces of the tags or labels 17 are provided with adhesive so that they can be attached to individual pieces of merchandise, for example, by sticking the labels on the merchandise or, in the case of rings, folding the tag of label around the shank of the ring and sticking opposite end portions of the tag or label together. Alternatively the tags or labels 17 may be affixed to the merchandise in other suitable manner, for example, by stapling. While only three labels have been illustrated in FIG. 1**, it will be understood that the number and size of labels can be increased or decreased as desired.

Figure 2:
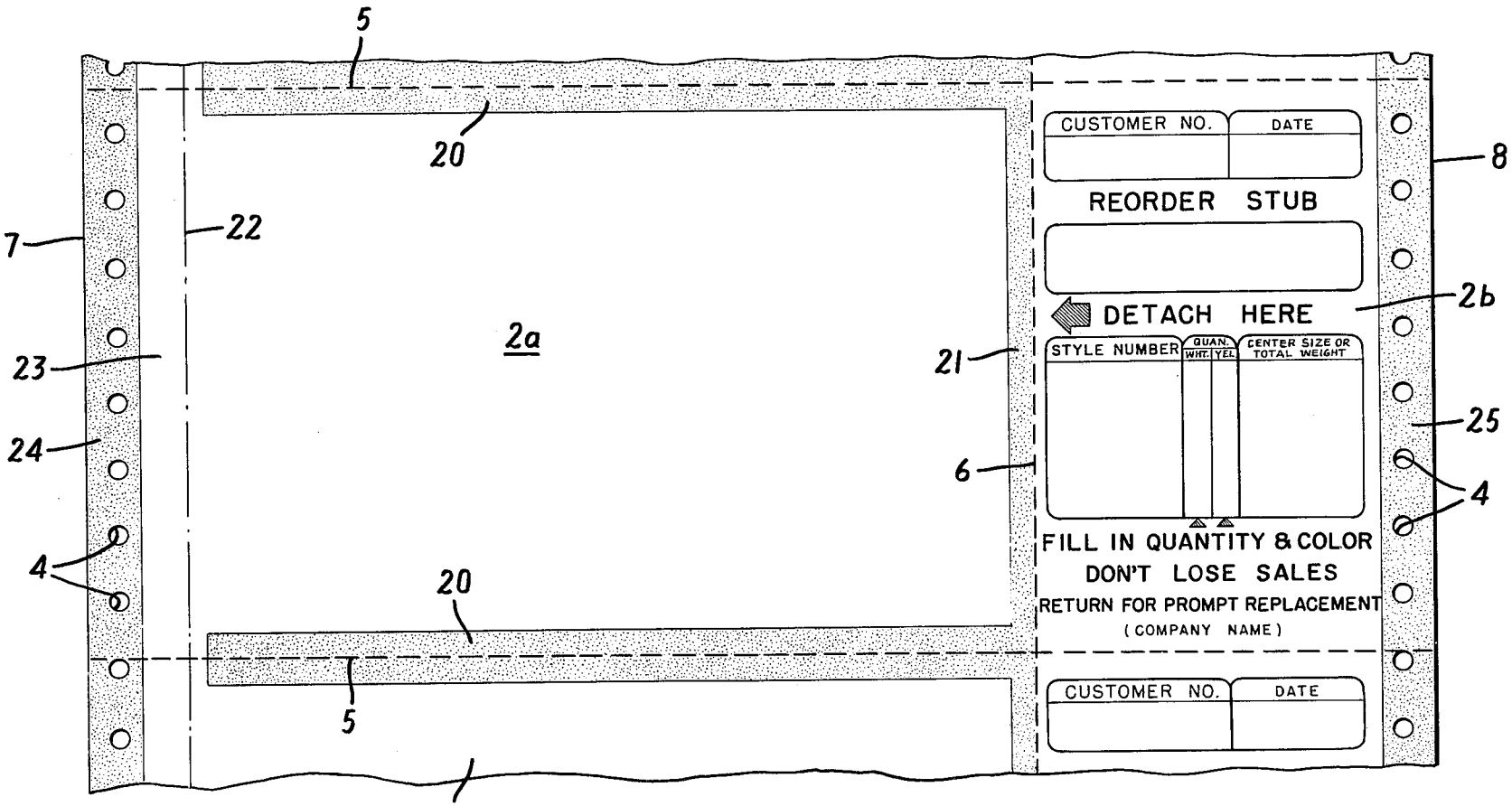
FIG. 2 is a corresponding view showing the second ply.

With reference to FIG. 2, the larger rectangular portion 2*a* of the second ply 2 of each unit forms the back of the envelope E and is adhesively bonded to the front ply 1*a* by transverse glue lines 20 extending along the transverse tear lines 5 and a longitudinally extending glue line 21, extending along the longitudinal tear line 6. The front and the back of the envelope are thus united along three edges while the fourth edge is open. A portion 23 of the second ply 2 extends laterally beyond the edge 7*a* of the first ply 1 so as to form a flap of the envelope adapted to be folded over along a fold line 22. The feed holes 4 at the left-hand side of the manifold are located in this flap portion 23. Adhesive 24 is provided on the flap 23 so as to seal the envelope.

The smaller portion 2*b* of the second ply 2 at the right-hand side of the tear line 6 as seen in FIG. 2 constitutes a reorder stub to be used in reordering the same items of merchandise when it is desired to replenish the stock. The reorder stub contains the same information as on the part 1*b* of the first ply 1 including a description 13*a* of the goods, further identification 13*b* of the goods, customer number 14, etc. However it is not provided with perforations corresponding to the perforation lines 15 and 16 of the first ply. At the right-hand margin of the manifold the portion 2*b* of the second ply is separably attached to the portion 1*b* of the first ply by a line of adhesive 25. The width and strength of the adhesive line 25 may be varied and may be narrower than shown so as to facilitate separation of the reorder stub 2*d* of the second ply from the portion 1*b* of the first ply.

Figure 4:
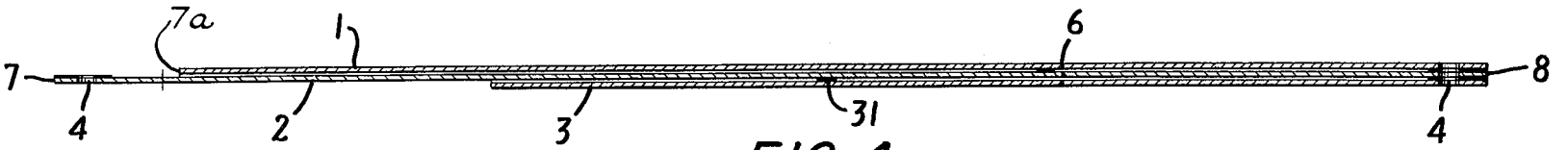
FIG. 4 is a longitudinal section taken approximately on the line 4—4 in FIG. 1.
Figure 3:
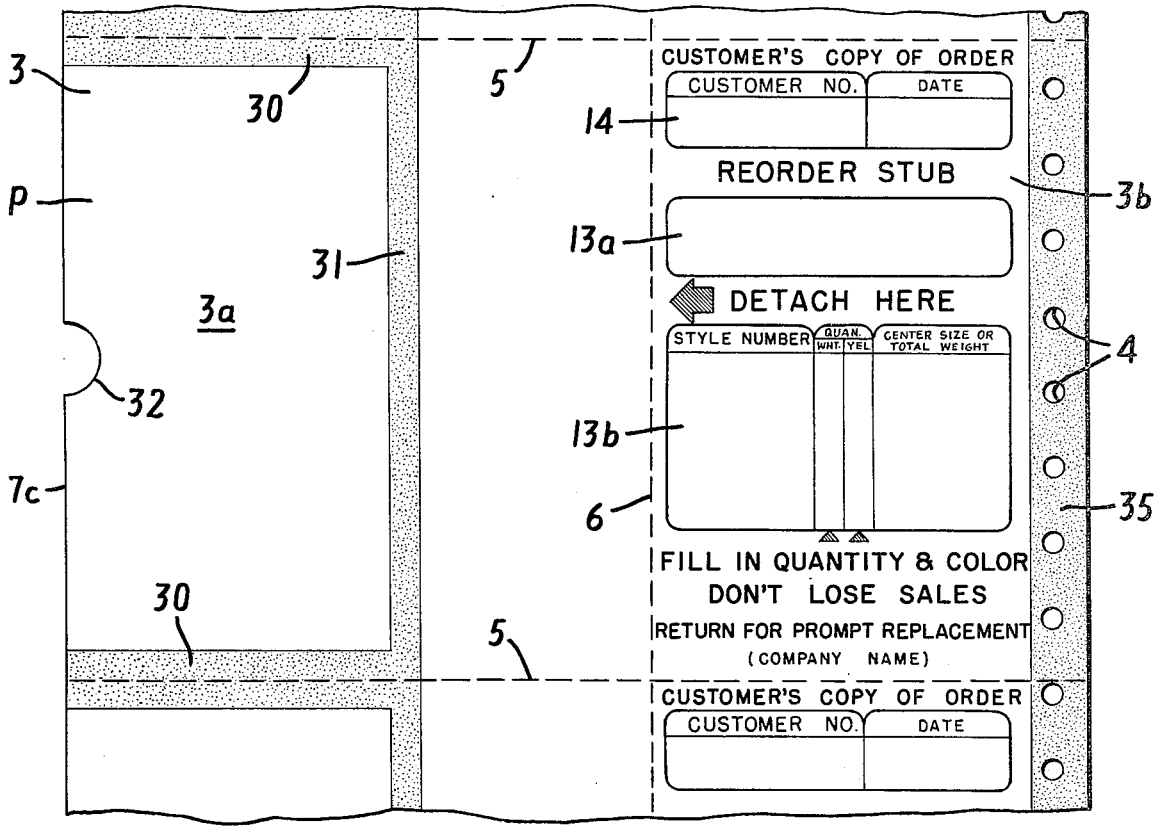
FIG. 3 is a corresponding view showing the third ply.
Figure 5:
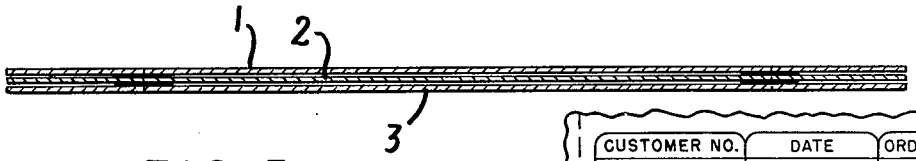
FIG. 5 is a transverse section taken approximately on a line 5—5 in FIG. 1.
Figure 6:
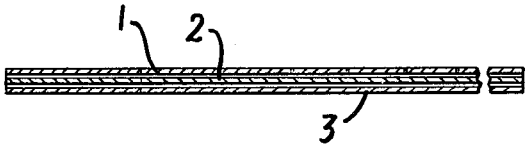
FIG. 6 is a partial section taken approximately on a line 6—6 in FIG. 1.

The portion 3*a* of the third ply 3 at the left of the tear line 6 as viewed in FIG. 3 is attached to the back of the portion 2*a* of the second ply along glue lines 30 and 31 to form a pocket P for receiving an IBM or other card (not shown) for controlling the processing of the order of merchandise to be received in the envelope E. The glue lines 30 extend along the transverse tear lines 5 but the glue line 31 is shown as spaced to the left of the longitudinal tear line 6 to provide a pocket of suitable depth for the card that is to be received. It will be understood that the glue line 31 is located as desired according to the size of the card. Moreover as seen in FIG. 4, the left-hand edge 7*c* of the portion 3*a* of the third ply 3 is spaced inwardly from the left-hand margin of the manifold. Hence the feed holes 4 at the left-hand side of the manifold extend only through the second ply 2. The width of the third ply 3 is coordinated with the location of the glue line 31 to provide a pocket P of the desired depth. An arcuate cut-out 32 is provided in the edge 7*c* of the portion 3*a* to facilitate insertion and withdrawal of a card received in the pocket P.

The portion 3*b* of the third ply 3 at the right-hand side of the tear line 6 as seen in FIG. 3, constitutes a duplicate of the reorder stub and contains the same information as the stub 2*b* including a description 13*a* of the merchandise, identification 13*b* of the style, etc., of the merchandise and customer's number 14. The duplicate reorder stub 3*b* is removably attached to the reorder stub 2*b* by a glue line 35 which, like the glue line 25, is of suitable width and strength to attach the stubs to one another while permitting them to be readily separating without tearing the stubs. The feed holes 4 at the right-hand side of the manifold extend through all three plies.

Suitable means is provided to that information applied to the portion 1*b* of the first ply 1 is transferred to the portion 2*b* of the second ply 2 and to the portion 3*b* of the third ply 3. For example, carbon paper inserts may be provided between the first, second and third plies or a carbon coating or carbon spots may be provided on the backs of the portions 1*b* and 2*b*. Hence when the manifold is run through processing equipment, for example, a high speed printer, controlled by a computer or other control means, information printed or impressed on portion 1*b* of the first ply will simultaneously be applied to portions 2*b* and 3*b* of the second and third plies.

The control card inserted in the pocket P is, for example an IBM card or computer programming card which controls the filling and processing of the order for merchandise to be shipped in the envelope E. The card may, for example, contain information for manufacturing or assembling the merchandise or for selecting it from stock. Moreover the cards may be used to control the printing or other processing equipment used for applying to the manifold the information appearing on part 1*a* of the first ply and on parts 1*b*, 2*b* and 3*b* of the first, second and third plies.

Figure 7:
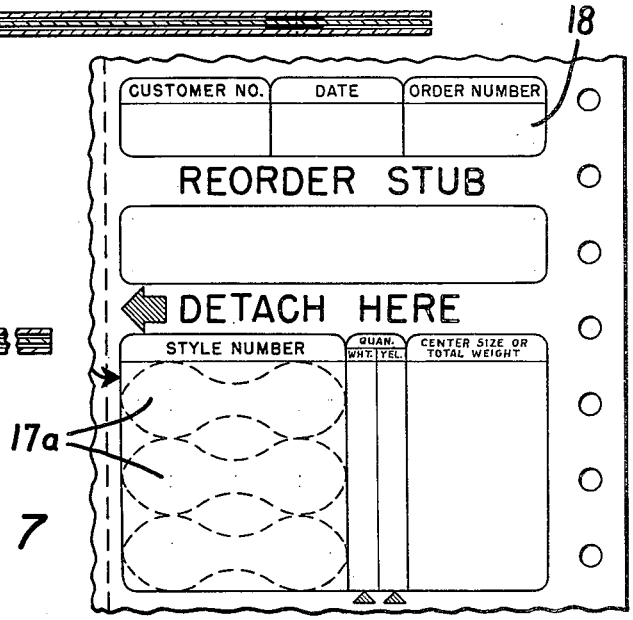
FIG. 7 is a fragmentary view corresponding to a portion of FIG. 1 but showing a modification.

In FIG. 7 there is shown a modification in which the tags or labels 17*a*, instead of being rectangular, are dumbbell-shaped with a central portion of lesser width so that they can be applied still more readily to the shank of a ring. Moreover the form of the reorder stub is modified in order to provide for entry of an order number 18, in addition to the other information shown in FIG. 1. It will be understood that the same information appears on the reorder stub and duplicate reorder stub of the second and third plies.

When an order is filled, the merchandise identified by the information on the envelopes is inserted into the respective envelopes and the flaps 23 are sealed to close the envelopes. The successive units of the manifold are separated from one another, for example, by suitable burster equipment, either before or after insertion of the merchandise into the envelopes. However the portions 1*b*, 2*b* and 3*b* are left attached to the envelopes. The control cards are removed from the pockets P and retained by the supplier for record purposes or future use. When the customer, for example, a retailer, receives a shipment, he removes the merchandise from the envelope and applies to the individual articles the tags or labels 17 which he separates from the portion 1*b* of the first ply. The remaining part of the portion 1*b* may be left attached to the envelope or may be discarded. The reorder stub 2*b* and duplicate reorder stub 3*b* are detached from the envelope and may be kept in a suitable file drawer or box to provide a convenient inventory of the merchandise received. When is it desired to reorder the merchandise, a customer merely fills in the number of items of each style number that he desires to reorder, sends the reorder stub back to the supplier and keeps the duplicate reorder stub for his records. In the form shown by way of example in the drawings the reorder stub is made still more convenient by providing separate columns for white or yellow gold in which the item is to be supplied. Upon receiving the reorder stub, the supplier has all the information that he needs for quickly and economically filling the new order. It will thus be seen that the manifold of the present invention is convenient and economical to use both by the supplier and by the customer.

While a preferred embodiment of the invention has been shown by way of example in the drawings and is herein particularly described, the invention is in no way limited to such embodiment. Instead of having three identifying tags or labels 17 as shown in the drawings, any desired number of detachable tags or labels can be provided. If more tags or labels are desired, the form can be made suitably wider or longer and, if desired, detachable tags or labels can be provided on one or more plies in addition to the front ply. The labels are preferably outlined in ink along the perforation lines so that their outlines are more readily visible. The printing on the form may, if desired, be of a character suitable for optical scanning or for magnetic reading. Moreover, the information on the forms may be suitably coded. Although feed holes have been shown at both edges of the manifold in accordance with present practice, the holes at one or both edges may be omitted if not required by the equipment on which the manifold is processed. Moreover, the pocket provided on the back of the envelope for a control card may be made larger or smaller as desired or it may be omitted if not required.

It will be understood that still other modifications may be made according to the requirements of the particular industry or merchandising field to which the manifold is applied. For example, instead of having only three plies, additional plies may be included, for example, to provide duplicate records or a return envelope. While the flap 23 of the envelope E is shown as being gummed, the envelope can be closed in any other convenient manner, for example, by stapling. The invention is hence in no way limited to the specific embodiments shown by way of example in the drawings.

What I claim and desired to secure by Letters Patent is:

1. An assembly for stocking, shipping, recording and reordering merchandise, comprising first, second and third separate plies of sheet material, each of said plies comprising a separate individual sheet of material not integral with any other of said plies, coincident separation lines in said superposed separate plies dividing each of said plies into a first portion and a second portion, means adhesively joining marginal portions of said first portions of said first and second plies to form a container receiving said merchandise, means on said first portion of said first ply identifying the merchandise in the container, the customer to whom the merchandise is to be shipped and an order number, means for closing said container to retain the merchandise therein, means joining marginal portions of said first portions of said second and third plies to form a pocket external of said container and accessible when said container is closed, coincident means on said second portions of two of said separate plies identifying the merchandise in said container and the customer to whom the merchandise is to be shipped and providing coincident blanks for filling in the quantity of like merchandise to be reordered, duplicating means between said second portions of said plies for transferring information entered on one of said plies to the other, said second portions of said two plies constituting first and second reorder forms, whereby a customer can reorder like merchandise by filling in the desired quantity in said blank on said first reorder form, said quantity being thereby automatically duplicated in said coincident blank on said second reorder form, sending one of said reorder forms to the supplier and keeping the other of said reorder forms for his records.

2. An assembly according to claim 1, comprising coincident means on said superposed reorder forms identifying said order number.

3. An assembly according to claim 1, in which said first portions of said plies are materially larger than said second portions.

4. An assembly according to claim 1, in which said first portion of said third ply is smaller than said first portions of said first and second plies whereby said pocket is smaller than said container.

5. An assembly according to claim 1, in which lines of perforations in said second portion of the third of said plies define severable identification tags for identifying individual articles of merchandise contained in said container.

6. An assembly according to claim 5, in which said identification tags are provided with means for attachment of said tags to said articles.

7. An assembly for stocking, shipping, recording and reordering merchandise, comprising a plurality of superposed separate plies of sheet material, each of said plies comprising a separate individual sheet of material not integral with any other of said plies, coincident separation lines in said superposed plies dividing each of said plies into a first quadrilateral portion and a second quadrilateral portion laterally adjoining said first portion on one side thereof, means adhesively joining marginal portions of said first portions of two superposed plies along three sides including a first side adjacent said second portions and the two sides adjoining said first side to form a container for said merchandise, said container having an opening at the fourth side opposite said first side for receiving said merchandise, means for closing said opening to retain said merchandise in the container, means on said container identifying the merchandise in the container, the customer to whom the merchandise is to be shipped and an order number, said second portions of two of said superposed plies comprising separate superposed first and second reorder forms detachably joined with said container along one side thereof by said coincident separation lines, coincident means on said separate reorder forms identifying the merchandise in said container and the customer to whom the merchandise is to be shipped, and providing coincident blanks for filling in the quantity of like merchandise to be reordered, and duplicating means between said separate superposed reorder forms for automatically transferring information entered on said first reorder form to said second reorder form, whereby a customer can reorder like merchandise by filling in the quantity of merchandise on said first reorder form, said quantity being thereby automatically duplicated on said second reorder form, sending one of said reorder forms to the supplied and keeping the other of said reorder forms for his records.

8. An assembly according to claim 7, comprising a further separate ply having a portion superposed with said reorder forms and having coincident means identifying said merchandise and said customer, said portion of said further ply having therein lines of perforations defining a plurality of several identification tags for identifying individual articles of said merchandise contained in said container.

9. An assembly according to claim 8, in which said identification tags are provided with means for attachment of said tags to said articles.

10. An assembly according to claim 7, further comprising means providing on the back of said container a pocket which is external of said container and is accessible when said container is closed.

11. An assembly according to claim 7, in which said first portions of said plies are materially larger than said second portions.

12. An assembly according to claim 7, comprising coincident means on said superposed reorder forms identifying said order number.

13. An assembly for shipping, stocking, identifying and reordering merchandise comprising a plurality of superposed separate plies of sheet material, each of said plies comprising a separate individual sheet of material not integral with any other of said plies, coincident separation lines in said superposed plies dividing each of said plies into a first quadrilateral portion and a second quadrilateral portion laterally adjoining said first portion on one side thereof, means adhesively joining marginal portions of said first portions of two superposed plies along three sides including a first side adjoining said second portions and the two sides adjoining said first side to form a container for said merchandise, said container having an opening at a fourth side opposite said first side for receiving said merchandise, means for closing said opening to retain said merchandise in the container, coordinated means on said first portion of the ply forming the front of said container and coincident means on said second portions of two of said separate superposed plies identifying the merchandise in the container, an order number and the customer to whom the merchandise is to be shipped, duplicating means between said second portions of said separate superposed plies for automatically transferring information entered on one ply to the other, perforations around said merchandise identifying means on said second portion of one of said separate superposed plies to provide a severable portion for attachment to an individual article of said merchandise to identify the same, and further means on the other of said second portions of said separate superposed plies providing a blank adjacent said merchandise identifying means for filling in the quantity of like merchandise to be reordered, whereby a customer can reorder like merchandise merely by filling in the desired quantity of merchandise in said blank and sending said other second portion to the supplier.

14. An assembly according to claim 13, in which said second portion having said identification tags further has means providing a blank for filling in the quantity of like merchandise to be reordered, said blank being coincident with the blank on said reorder form, and duplicating means being provided between said second portions of said plies, whereby said second portion having said identification tags serves the further function of a duplicate reorder form.

15. A package assembly comprising at least one article of merchandise, a plurality of superposed separate plies of sheet material, each of said plies comprising a separate individual sheet of material not integral with any other of said plies, coincident separation lines in said superposed plies dividing each of said plies into a first quadrilateral portion and a second quadrilateral portion laterally adjoining said first portion on one side thereof, means adhesively joining marginal portions of said first portions of two superposed plies along three sides including a first side adjacent said second portions and the two sides adjoining said first side to form a container for said merchandise, said container having an opening at the fourth side opposite to said first side for receiving said merchandise, means closing said opening to retain said merchandise in the container, means on said container identifying the merchandise in the container, the customer to whom the merchandise is to be shipped and an order number, said second portions of two of said superposed plies comprising separate superposed first and second reorder forms detachably joined with said container along one side thereof, coincident means on said separate reorder forms identifying the merchandise in said container and the customer to whom the merchandise is to be shipped, and providing coincident blanks for filling in the quantity of like merchandise to be reordered, and duplicating means between said separate superposed reorder forms for automatically transferring information entered on said first reorder form to said second reorder form, whereby a customer can reorder like merchandise by filling in the quantity of merchandise on said first reorder form, said quantity being thereby automatically duplicated on said second reorder form, sending one of said reorder forms to the supplier and keeping the other of said reorder forms for his records.

16. An assembly for stocking, shipping, identifying, recording and reordering merchandise, comprising first, second and third separate plies of sheet material, each of said plies comprising a separate individual sheet of material not integral with any other of said plies, coincident separation lines in all of said superposed separate plies dividing each of said plies into a first portion and a second portions, means adhesively joining marginal portions of said first portions of said first and second plies to form a container receiving said merchandise, means on said first portion of said first ply identifying the merchandise in the container, the customer to whom the merchandise is to be shipped and an order number, means for closing said container to retain the merchandise therein, means joining marginal portions of said first portions of said second and third plies to form a pocket external of said container and accessible even when said container is closed, coincident means on said second portions of said three plies identifying the merchandise in said container and the customer to whom the merchandise is to be shipped, coincident means identifying blanks on said second portions of two of said plies for filling in the quantity of like merchandise to be reordered, duplication means between said second portions of said two plies for transferring information entered on one of said plies to the other, said second portions of said two plies constituting first and second reorder forms, whereby a customer can reorder like merchandise by filling in the desired quantity in said blanks on said first reorder form, said quantity being thereby automatically duplicated in said coincident blank on said second reorder form, sending one of said reorder forms to the supplier and keeping the other of said reorder forms for his records, said second portion of the third of said plies having thereon patterns of perforations defining severable identification tags for attachment to individual articles of merchandise contained in said container to identify the same.

* * * * *